United States Patent [19]

Suominen

[11] 4,316,353

[45] Feb. 23, 1982

[54] BAG SUPPORT AND DISPENSING APPARATUS

[76] Inventor: Heikki S. Suominen, 33730 Tampere 73, Finland

[21] Appl. No.: 66,723

[22] Filed: Aug. 15, 1979

[30] Foreign Application Priority Data

Feb. 16, 1979 [FI] Finland ..... 790513

[51] Int. Cl.[3] ..... B65B 43/26; B65B 67/04

[52] U.S. Cl. ..... 53/384; 53/390; 248/100

[58] Field of Search ..... 53/384, 385, 390, 572; 248/99, 100

[56] References Cited

U.S. PATENT DOCUMENTS

| | | | |
|---|---|---|---|
| 2,902,811 | 9/1959 | Joyce | 53/384 |
| 3,858,382 | 1/1975 | Suominen | 53/385 |
| 3,869,065 | 3/1975 | Wang | 53/384 X |

*Primary Examiner*—Travis S. McGehee

*Attorney, Agent, or Firm*—Pollock, Vande Sande & Priddy

[57] ABSTRACT

A bag support and dispensing apparatus having a support shaft for supporting a plurality of stacked bags by engaging each bag in the stack through aligned apertures in the front and rear walls of the bag. A pivotally mounted, extending hanger is positioned opposite the support shaft to engage a front wall of the top-most bag in the stack through an associated aperture in the front wall, so that the bag is supported in an open loading position by the support shaft at the rear wall and the extending hanger at the front wall. The extending hanger may be pivoted forwardly and upwardly to disengage the hanger from the bag and to allow the bag to be easily removed from the bag support apparatus. The hanger falls back to a loading position after it is released.

9 Claims, 3 Drawing Figures

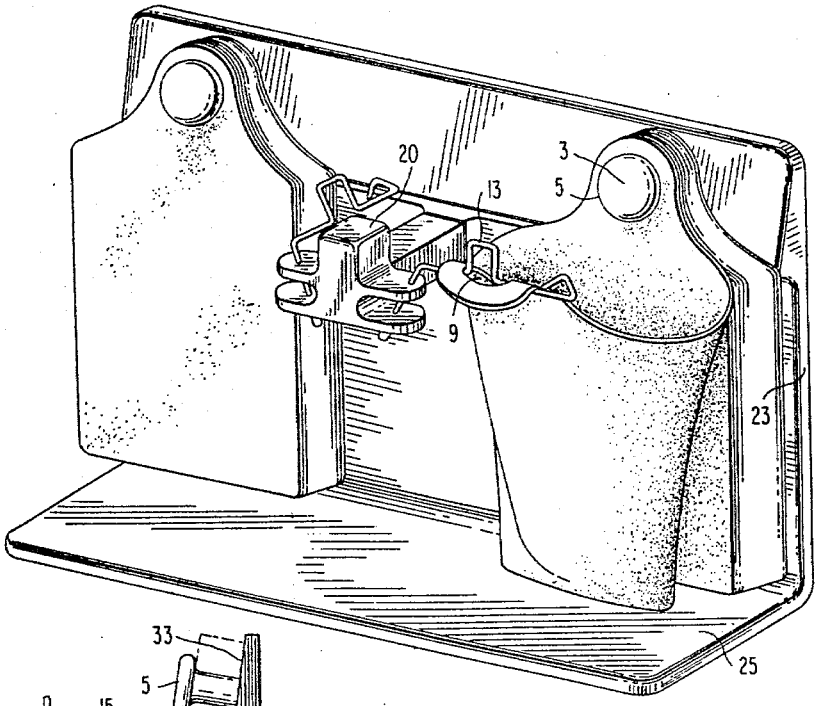
FIG. 1
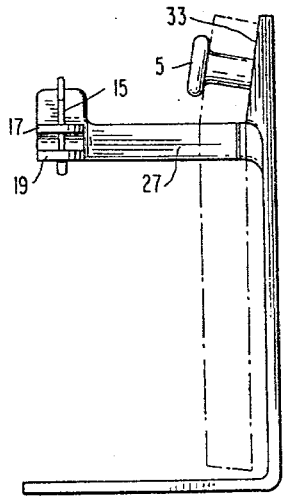
FIG. 2
FIG. 3
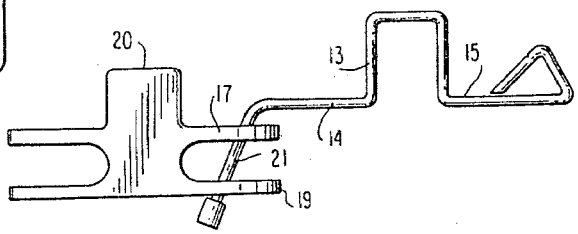

BAG SUPPORT AND DISPENSING APPARATUS

DESCRIPTION

1. Technical Field

The invention relates to a bag support and dispensing apparatus and, more particularly, to such an apparatus including a pivotally mounted extending hanger for supporting the front wall of a bag in a loading position and pivoting upwardly and outwardly to disengage from the front wall so that a loaded bag may be easily removed.

2. Background Art

In the U.S. Pats. to Suominen, No. 3,858,382 and No. 3,973,376, there is disclosed a bag support apparatus including a shaft that passes through aligned apertures in the front and rear walls of a plurality of stacked plastic bags. The top portion of the front wall of each bag has an aperture that is sufficiently large to easily pass a large flange that is affixed to the free end of the shaft. Thus, when the front edge of the bag is pulled outwardly, the front wall is disengaged from the shaft. However, as the bag is pulled outwardly a smaller aligned aperture in the rear wall of the bag catches on the flange, so that a bag loader may hold the bag in an open position to receive articles.

After the bag is loaded, the bag is disengaged from the shaft by pulling the bag in a forward direction with sufficient force to distend the smaller rear aperture, so that the flange passes through the rear aperture.

The above bag support apparatus tends to be somewhat complicated in construction, thereby resulting in higher manufacturing costs. In addition, the apparatus is not easily utilized to support a plurality of plastic bags in an open position so that the bags may be simultaneously loaded. Also, the apparatus does not provide a hanger for supporting the front wall of a bag in a loading position and easily releasing the front wall of the bag after the bag is loaded.

It is also known in the bag support art to hang shoulder portions of a bag from wire support loops, so that the bag is supported in a loading position. In such a prior art support apparatus a support loop may be disengaged from the shoulder of a loaded bag by moving the support loop outwardly. However, the support loop does not automatically return to a loading position after it has been moved to dispense a loaded bag. In addition, the apparatus does not include means for supporting a stack of bags and easily moving the top-most bag of the stack to a loading position.

Accordingly, it is a primary object of the invention to provide a bag support and dispensing apparatus for easily moving a bag in a stack of bags into a supported loading position, and for easily releasing the bag after it is loaded.

Another object of the invention is to provide such a bag support and dispensing apparatus having a support hanger that moves upwardly and outwardly to easily release a loaded bag and that automatically returns to a loading position.

DISCLOSURE OF THE INVENTION

In order to achieve the objects of the invention, and to overcome the problems of the prior art, the apparatus for supporting and dispensing bags includes a bag support shaft that supports an upright stack of bags by engaging each of the bags in the stack through aligned apertures in the front and rear walls.

In a preferred embodiment of the invention, the front edge of a bag is pulled outwardly, so that a flange that is mounted on the end of the support shaft passes through a large aperture in the front wall of the bag. As the bag is opened, a corresponding smaller aligned aperture in the rear wall catches on the flange and, thereafter, the aperture in the front wall of the bag is engaged with a pivotally mounted extending hanger. In the loading position, the extending hanger supports the front wall of the bag and the support shaft supports the rear wall of the bag.

After the bag is loaded, the front wall of the bag is disengaged from the extending hanger by pivoting the hanger upwardly and outwardly, and the back wall of the bag is pulled in a forward direction with sufficient force to distend the smaller rear aperture, so that the flange on the support shaft is passed through the rear aperture and the bag is disengaged from the shaft. After the loaded bag has been removed from the apparatus of the invention the hanger may be released to fall back to a loading position.

A plurality of support shafts and associated extending hangers may be employed to support a plurality of bags so that the bags may be loaded simultaneously.

BRIEF DESCRIPTION OF THE DRAWINGS

FIG. 1 illustrates a perspective view of a bag support and dispensing apparatus according to the invention.

FIG. 2 illustrates a side elevation view of the bag support apparatus of FIG. 1.

FIG. 3 illustrates a front elevation view of the bag support loop of FIG. 1.

BEST MODE FOR CARRYING OUT THE INVENTION

The remaining portion of this specification will describe a preferred embodiment of the invention when read in conjunction with the attached drawings, in which like reference characters identify identical apparatus.

As shown in FIG. 1, a plurality of stacked bags 1, for example plastic bags, having aligned apertures in the respective front and back walls are engaged with associated support shafts 3 that pass through the aligned apertures of the stacked bags. Each of the support shafts has an outward flange 5 that contacts the front wall of the top-most bag of a stack of bags when the bags are engaged with the support shaft.

In loading a top-most bag, the front wall of the bag is pulled outwardly from the stack of bags so that the flange 5 of the support shaft 3 passes through an enlarged aperture 9 in the front wall. As the front wall is pulled in an outward direction, a corresponding smaller aligned aperture in the rear wall of the bag catches on the flange 5 so that the rear wall of the bag is supported in a loading position. The extended front wall of the bag is then engaged an upwardly extending loop 13 formed in a horizontally extending portion 14 of a hanger arm 15 by passing the loop 13 through the enlarged front aperture 9.

A loaded bag is removed by pulling forwardly and upwardly on the hanger arm 15 so that the arm pivots in an associated top bearing bracket 17 and bottom bearing bracket 19, thereby moving the loop 13 out of engagement with the front aperture 9 of the front wall of the loaded bag. Since the hanger arm 15 and associated loop 13 have moved forwardly and upwardly, the loaded bag may be easily removed by pulling on the bag with sufficient force to distend the small rear aperture, so that the flange 5 is passed through the rear aperture and the bag is disengaged from the shaft 3.

As shown in FIG. 1, a downwardly extending portion 21 of the hanger arm 15 passes at an angle through associated holes in the top bearing bracket 17 and bottom bearing bracket 19. Thus, when the downwardly extending portion 21 pivots in the bearing brackets 17 and 19, the horizontally extending portion 14 and associated loop 13 are moved upwardly and outwardly.

When the hanger arm 15 is raised to disengage the loop 13 from the front wall of a bag, the hanger arm may be engaged with a top edge of a retainer member 20 to hold the arm in an upward position. After the bag is removed, the hanger arm is released from the retainer member 20 by pulling upwardly on the arm and then releasing the arm so that it falls to the loading position. The diagonal engagement of the downwardly extending portion 21 of the hanger arm with the bearings 17 and 19 not only defines the upward and outward movement of the loop 13, but also ensures that the weight of the hanger arm 15 will return the arm to a loading position.

FIG. 1 shows an embodiment of the invention wherein two support shafts and associated extending hangers 15 are used to simultaneously support two bags in a loading position. However, it should be appreciated that additional support shafts and associated extending hangers may be employed to simultaneously support any number of bags.

The bag support apparatus of FIG. 1 includes a support rack having a support wall 23 and a floor 25 that provide a sturdy means of support for the hanging bags. It should be understood that the support rack may be fastened in a manner known to the art to a counter, for example a cashier's counter in a store, so that a cashier or other bag loader has ready access to the bags and the merchandise that is to be loaded into the bags.

FIG. 2 illustrates a side elevation view of the bag support apparatus of FIG. 1. As shown in FIG. 2, an extending arm 27 may be attached to the back wall 29 of a support rack in any manner known to the art. The extending arm 27 is used to support the bearing brackets 17 and 19 and the associated hanger arm 15. A support flange 5 is affixed to an inclined support surface 33 of the rack to support a stack of bags in the above-described manner.

As shown in FIG. 1, the upwardly extending loop 13 may be formed on the horizontally extending portion 14 of the hanger arm 15 radially inwardly with respect to the axis of the flange 5, so that the loop 13 is less likely to snag on a bag loader's clothes during the loading operation.

Although FIG. 1 illustrates a radial inward positioning of the loop 13, it should be appreciated that the loop 13 may be formed in any position along the horizontally extending portion of the hanger arm 15 without departing from the spirit of the invention. Also, although an extending arm 27 and top and bottom bearing bracket plates 17 and 19 have been illustrated in FIG. 1, it should be understood that other means may be used to pivotally support a hanger arm 15 without departing from the spirit of the invention.

As shown in FIG. 1, the hanger arm 15 may be formed from rigid material, for example wire, and an upwardly extending loop 13 in the hanger arm may be formed in a manner known to the art. However, it should be appreciated that the invention necessarily includes bag support hanger arms having a different structure. For example, a relatively thicker hanger arm having upwardly turned metal tabs or hooks may be used in place of the wire loop hanger arm illustrated in FIGS. 1 and 2. Also, the hanging apertures in the walls of a bag may be formed in various sizes or shapes without departing from the spirit of the invention.

The invention is not limited to a particular size or shape of the support flange 5 and also, is not limited to a particular means for attaching the support flange to the inclined support surface 23. For example, a support flange may be permanently affixed to the support surface 23 or the support surface 23 may include a support apparatus for detachably engaging disposable support flanges.

An apparatus for detachably engaging disposable support flanges is disclosed in a copending patent application of the inventor, Ser. No. 27,534, and the disclosure of the copending application is incorporated herein by reference.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. Bag support apparatus for supporting at least one stack of bags, maintaining a forwardmost bag in said at least one stack in a loading position and releasing the forwardmost bag after it is loaded, comprising:

stack support means for engaging aligned apertures in the front and rear walls of the bags in said at least one stack to support the stack in an upright position, said stack support means having means for engaging a rear aperture in the rear wall of said forwardmost bag when the forwardmost bag is in said loading position;

hanger means for engaging a front aperture in the front wall of said forwardmost bag when the bag is in said loading position; and means for pivotally supporting said hanger means for upward and forward movement to disengage said hanger means from said front aperture in said forwardmost bag.

2. The bag support apparatus of claim 1 wherein said hanger supporting means includes means for automatically returning said hanger means to a bag loading position after said hanger means has been moved upwardly and forwardly to disengage from an associated loaded bag.

3. The apparatus of claim 1 wherein said hanger means includes an upwardly extending loop and a downwardly extending support end that is pivotally engaged with said hanger support means.

4. The bag support apparatus of claim 3 including means for positioning said upwardly extending loop radially inwardly with respect to the axis of said stack support means.

5. The bag support apparatus of claim 1 wherein said hanger supporting means includes a top bearing means and a bottom bearing means and said hanger means includes a horizontally extending arm having an upwardly extending loop for engaging said front aperture of said front wall, said hanger means further including a downwardly extending support arm for pivotally engaging said top bearing means and said bottom bearing means in a position to allow said horizontally extending arm to be pivoted upwardly and forwardly to release the front wall of a supported bag.

6. The bag support apparatus of claim 1 including a plurality of said stack support means and associated pivotally mounted hanger means for maintaining a plurality of bags in said loading position and releasing a bag when the bag is loaded.

7. The bag support apparatus of claim 1 wherein said stack support means is a support shaft having a flange on its free end, the flange dimensioned to pass through the front aperture of a bag and to resist passing through the rear aperture of the bag.

8. The bag support apparatus of claim 1 including a retainer means for frictionally engaging said hanger means to retain said hanger means in a disengaged relation to the front aperture in said forward-most bag.

9. Apparatus for supporting at least one bag in a loading position and releasing the bag after it is loaded, comprising:

support means for engaging a rear aperture in the rear wall of a bag when the bag is in said loading position;

hanger means for engaging a front aperture in the front wall of a bag when the bag is in said loading position; and means for rotatably supporting said hanger means for upward and forward movement to disengage said hanger means from said front aperture in said at least one bag.

* * * * *